US011828531B2

(12) United States Patent
Wittes et al.

(10) Patent No.: US 11,828,531 B2
(45) Date of Patent: Nov. 28, 2023

(54) USER INTERFACE MODULE WITH ADJUSTABLE MOUNT FOR DOMESTIC APPLIANCE

(71) Applicants: BSH Home Appliances Corporation, Irvine, CA (US); BSH Hausgeräte GmbH, Munich (DE)

(72) Inventors: Joshua Wittes, Oak Ridge, TN (US); Cemalettin Hasturk, Knoxville, TN (US); Murat Zengin, Tekirdağ (TR); Göksel Göktepe, Tekirdağ (TR); Tobias Hochstatter, Neresheim (DE); Alpkan Başaran, Tekirdağ (TR); Michael Pfister, Giengen an der Brenz (DE)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 161 days.

(21) Appl. No.: 17/484,181

(22) Filed: Sep. 24, 2021

(65) Prior Publication Data

US 2023/0094803 A1 Mar. 30, 2023

(51) Int. Cl.

| | |
|---|---|
| ***F25D 25/02*** | (2006.01) |
| ***A47B 88/956*** | (2017.01) |
| ***F25D 23/02*** | (2006.01) |
| ***A47B 88/95*** | (2017.01) |

(52) U.S. Cl.

CPC ..... *F25D 25/025* (2013.01); *A47B 88/956* (2017.01); *F25D 23/028* (2013.01); *A47B 2088/952* (2017.01); *A47B 2210/175* (2013.01)

(58) Field of Classification Search

CPC .. F25D 25/025; F25D 23/028; F25D 2400/18; F25D 23/10; F25D 2400/36; A47B 88/956; A47B 2088/952; A47B 2210/175; A47L 15/4257; A47L 15/4293;

(Continued)

(56) References Cited

U.S. PATENT DOCUMENTS

| | | | |
|---|---|---|---|
| 4,557,118 | A | 12/1985 | Pink |
| 8,038,234 | B2 | 10/2011 | Weber |
| 9,101,211 | B2 | 8/2015 | Cabal Velarde |

(Continued)

FOREIGN PATENT DOCUMENTS

| | | | | |
|---|---|---|---|---|
| CN | 106247745 A | * | 12/2016 | ..... F25D 23/02 |
| CN | 205788916 U | * | 12/2016 | |

(Continued)

OTHER PUBLICATIONS

International Search Report PCT/EP2022/074809 dated Nov. 14, 2022.

*Primary Examiner* — Hanh V Tran

(74) *Attorney, Agent, or Firm* — Michael E. Tschupp; Andre Pallapies; Brandon G. Braun

(57) ABSTRACT

An adjustable user interface module (UIM) for a domestic appliance is provided and includes an adjustable UIM housing; a UIM electronic component mounted to the adjustable UIM housing; and a pair of adjustable fastening members adapted to mount the adjustable UIM housing to the domestic appliance, each of the adjustable fastening members being configured to adjust the adjustable UIM housing in at least an up and down direction to in turn adjust the height of the UIM electronic component.

21 Claims, 10 Drawing Sheets

(58) Field of Classification Search
CPC ..... D06F 34/34; D06F 39/14; F24C 7/085; F24C 15/02
See application file for complete search history.

(56) References Cited

U.S. PATENT DOCUMENTS

| | | | | |
|---|---|---|---|---|
| 9,149,116 | B2 | 10/2015 | Gasser | |
| 9,752,817 | B2 | 9/2017 | Richards | |
| 10,575,639 | B2 | 3/2020 | Liu | |
| 10,660,437 | B2 | 5/2020 | Prentner | |
| 10,794,627 | B2 * | 10/2020 | Olvera | E05D 15/28 |
| 10,907,884 | B1 * | 2/2021 | Scorsim | F25D 23/028 |
| 2004/0216471 | A1 | 11/2004 | Kim | |
| 2006/0145576 | A1 | 7/2006 | Lee | |
| 2006/0261220 | A1 | 11/2006 | Lee | |
| 2007/0086151 | A1 | 4/2007 | Oh | |
| 2008/0164224 | A1 | 7/2008 | McCoy | |
| 2008/0165475 | A1 | 7/2008 | McCoy | |
| 2009/0320892 | A1 * | 12/2009 | Poyner | A47L 15/4293 222/630 |
| 2010/0283359 | A1 | 11/2010 | Hottmann | |
| 2012/0146478 | A1 * | 6/2012 | Arslankiray | F25D 23/02 312/405 |
| 2014/0014557 | A1 | 5/2014 | Anderson | |
| 2014/0145579 | A1 * | 5/2014 | Anderson | F25D 29/005 29/428 |
| 2015/0020537 | A1 * | 1/2015 | Arslankiray | F25D 23/126 62/395 |
| 2017/0005923 | A1 | 3/2017 | Anderson | |
| 2017/0167779 | A1 * | 6/2017 | Haeberle | F25D 25/025 |
| 2017/0176088 | A1 * | 6/2017 | Richards | F25D 23/028 |
| 2020/0296851 | A1 * | 9/2020 | Gerstmayr | H05K 5/0017 |
| 2021/0041160 | A1 * | 2/2021 | Feldmeyer | F25D 29/005 |

FOREIGN PATENT DOCUMENTS

| | | | | | |
|---|---|---|---|---|---|
| CN | 108917285 | A | * | 11/2018 | F25D 29/005 |
| CN | 111156780 | A | * | 5/2020 | F25D 11/00 |
| CN | 111664648 | A | * | 9/2020 | F25D 11/02 |
| CN | 113074485 | A | * | 7/2021 | |
| DE | 102006020826 | A1 | * | 11/2006 | F25D 23/02 |
| EP | 2199715 | A2 | * | 6/2010 | A47B 95/02 |
| EP | 3190366 | B1 | * | 3/2020 | A47F 3/0434 |
| KR | 20030046595 | A | | 6/2003 | |
| KR | 20050066532 | A | | 6/2005 | |
| KR | 20050077597 | A | | 8/2005 | |
| KR | 20050077858 | A | | 8/2005 | |
| KR | 20060077318 | A | | 7/2006 | |
| KR | 20070002355 | A | | 1/2007 | |
| NZ | 548130 | A | | 9/2007 | |
| WO | WO-2019170522 | A1 | * | 9/2019 | F25D 23/028 |

* cited by examiner

USER INTERFACE MODULE WITH ADJUSTABLE MOUNT FOR DOMESTIC APPLIANCE

FIELD OF THE INVENTION

The present disclosure relates generally to a user interface module for an appliance and to an adjustable user interface module with an adjustable housing or mount for a domestic appliance.

The present disclosure further relates to a drawer user interface module with an adjustable mount for a domestic appliance such as, but not limited to, a refrigerator appliance, to a middle (also referred to as flexible or pantry), adjustable temperature drawer having the user interface module with an adjustable mount, and to a refrigerator appliance having an adjustable temperature drawer with the adjustably mountable user interface module.

BACKGROUND OF THE INVENTION

In general, in built-in products such as domestic or household appliances, the decorative doors or custom panels are adjustable to match the cabinets around the product. It is much more common for built-in refrigerators, for example, to have two or less different temperature compartments, so that either the product has a singular compartment that is entirely a fresh food compartment or entirely a freezer compartment, or there are two compartments, one of which is a freezer compartment and the other is a fresh food compartment. Due to this limited compartment complexity mixed with the complexity of creating an interface on the door that can be adjusted to align the user interface module to the top of the decorative door, this solution does not exist today.

On the other hand, in free standing refrigerators, it is more common for the customer to have three or more compartments in which a stationary cabinet temperature control is not as intuitive. In these products, there is often a user interface module that is on a stationary top cover of the middle (pantry/flex) drawer or on the top of the middle drawer itself that allows the user to manipulate the temperature inside the compartment. However, the user interfaces in these free standing refrigerators mount directly into the foamed door without adjustment. This is because the foamed door on a freestanding refrigerator appliance is the aesthetic door, and any adjustment that needs to be made, must be made on the complete door itself.

SUMMARY OF THE INVENTION

However, there are no products that offer a user interface module (UIM) on top of any external drawers for built-in products such as domestic or household appliances. Moreover, there are no adjustable user interface modules for freestanding appliances such as refrigerators.

An apparatus consistent with the present disclosure is directed to providing an adjustable user interface module for a domestic appliance, a drawer having an adjustable user interface module, and to a domestic appliance having an adjustable UIM.

An apparatus consistent with the present disclosure provides an independent mounting structure for the user interface module. The mounting structure also has the ability to be adjusted to follow the aesthetics of the kitchen cabinetry and decorative doors of domestic appliances.

An apparatus consistent with the present disclosure can be applied anywhere a decorative door/custom cabinet panel is used to cover the appliance. For example, in high-end kitchens, the built-in appliance's front face is removable to allow the customer to use their custom cabinet panels to fully incorporate the appliance into the cabinetry aesthetics. An apparatus consistent with the present disclosure can be used on any built-in appliance including, but not limited to, refrigerators, freezers, dishwashers, ovens, ice makers, wine coolers, and the like.

According to one aspect, the present disclosure provides an adjustable user interface module (UIM) for a domestic appliance, comprising: an adjustable UIM housing; a UIM electronic component mounted to the adjustable UIM housing; and a pair of adjustable fastening members adapted to mount the adjustable UIM housing to the domestic appliance, each of the adjustable fastening members being configured to adjust the adjustable UIM housing in at least an up and down direction to in turn adjust the height of the UIM electronic component.

According to another aspect, each of the adjustable fastening members comprises an adjustment screw having a shaft with a lower threaded portion, an upper threaded portion, and a washer-shaped portion fixed to the shaft of the adjustment screw and separating the lower threaded portion from the upper threaded portion.

According to another aspect, each of the adjustable fastening members comprises a locking nut that is configured to be threaded on the upper threaded portion of a corresponding one of the adjustment screws to fix the adjustable UIM housing in position.

According to another aspect, each of the adjustment screws is formed with a tool-shaped indentation at a top of the shaft and which is adapted to receive a head of a like shaped fastening tool.

According to another aspect, the adjustable UIM housing includes openings in a right end portion and a left end portion that are respectively fitted over the upper threaded portions of the adjustment screws such that a bottom of the adjustable UIM housing rests on upper surfaces of the washer-shaped portions.

According to another aspect, the openings are elongated in a front and rear direction and thus larger than a diameter of the upper threaded portions of the adjustment screws, such that the adjustable UIM housing is configured to be adjusted in the front and rear direction with respect to the adjustment screws.

According to another aspect, the adjustable UIM housing includes reinforcement ribs provided on the right end portion and on the left end portion.

According to another aspect, the present disclosure provides a drawer for a domestic appliance, comprising: a door assembly mounted to a front portion of the drawer; an adjustable UIM housing disposed on the door assembly; a UIM electronic component mounted to the adjustable UIM housing; and a pair of adjustable fastening members which mount the adjustable UIM housing to the door assembly of the drawer, each of the adjustable fastening members being configured to adjust the adjustable UIM housing in at least an up and down direction to in turn adjust the height of the UIM electronic component with respect to the door assembly.

According to another aspect, the drawer comprises an adjustable temperature drawer for a refrigerator appliance.

According to another aspect, the door assembly comprises an outer decorative door, an inner foamed door assembly, the UIM electronic component, the adjustable UIM housing, a door top cover, and a door fixation bar.

According to another aspect, each of the adjustable fastening members comprises an adjustment screw having a shaft with a lower threaded portion, an upper threaded portion, and a washer-shaped portion fixed to the shaft of the adjustment screw and separating the lower threaded portion from the upper threaded portion.

According to another aspect, each of the adjustable fastening members comprises a locking nut that is configured to be threaded on the upper threaded portion of a corresponding one of the adjustment screws to fix the adjustable UIM housing in position.

According to another aspect, the adjustable UIM housing includes openings in a right end portion and a left end portion that are respectively fitted over the upper threaded portions of the adjustment screws such that a bottom of the adjustable UIM housing rests on upper surfaces of the washer-shaped portions.

According to another aspect, the openings are elongated in a front and rear direction and thus larger than a diameter of the upper threaded portions of the adjustment screws, such that the adjustable UIM housing is configured to be adjusted in the front and rear direction with respect to the adjustment screws and a top of the drawer assembly.

According to another aspect, the adjustable fastening members are configured to adjust the adjustable UIM housing in an up and down direction to in turn adjust the height of the UIM electronic component with respect to the outer decorative door of the door assembly, such that the UIM electronic component is flush with the outer decorative door.

According to another aspect, the door top cover is configured to slide in between a portion of the UIM electronic component and a top portion of the adjustable UIM housing.

According to another aspect, the present disclosure provides a domestic appliance, comprising: a door assembly mounted to a front portion of the domestic appliance; an adjustable UIM housing disposed on the door assembly; a UIM electronic component mounted to the adjustable UIM housing; and a pair of adjustable fastening members which mount the adjustable UIM housing to the door assembly of the domestic appliance, each of the adjustable fastening members being configured to adjust the adjustable UIM housing in at least an up and down direction to in turn adjust the height of the UIM electronic component with respect to the door assembly.

According to another aspect, the domestic appliance comprises a refrigerator appliance and the door assembly is disposed on an adjustable temperature drawer of the refrigerator appliance.

According to another aspect, the door assembly comprises an outer decorative door, an inner foamed door assembly, the UIM electronic component, the adjustable UIM housing, a door top cover, and a door fixation bar, and the refrigerator appliance comprises a built-in refrigerator appliance and the outer decorative door is removable from the door assembly.

According to another aspect, the adjustable fastening members are configured to adjust the adjustable UIM housing in an up and down direction to in turn adjust the height of the UIM electronic component with respect to the outer decorative door of the door assembly, such that the UIM electronic component is flush with the outer decorative door.

According to another aspect, the domestic appliance comprises one of a dishwasher, a washing machine, a dryer, or an oven.

BRIEF DESCRIPTION OF THE DRAWING FIGURES

The accompanying drawing figures incorporated in and forming a part of this specification illustrate several aspects of the invention, and together with the description serve to explain the principles of the invention.

FIG. 1 is a perspective view showing a door assembly for a domestic appliance including a decorative outer door and the user interface which is flush with the decorative door according to an exemplary embodiment consistent with the present disclosure;

FIG. 2 shows exploded perspective views of the door assembly for an appliance and, in particular, shows the outer decorative door, the inner foamed door assembly, the adjustable UIM housing or mount, the door top cover, and also shows the door fixation bar both on the outer decorative door (see below) and on the inner foamed door assembly (see above) according to an exemplary embodiment consistent with the present disclosure;

Figure 6A:
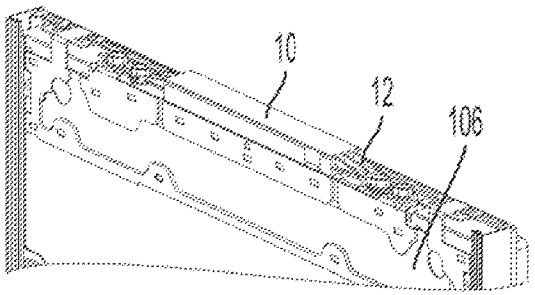
Figure 6B:
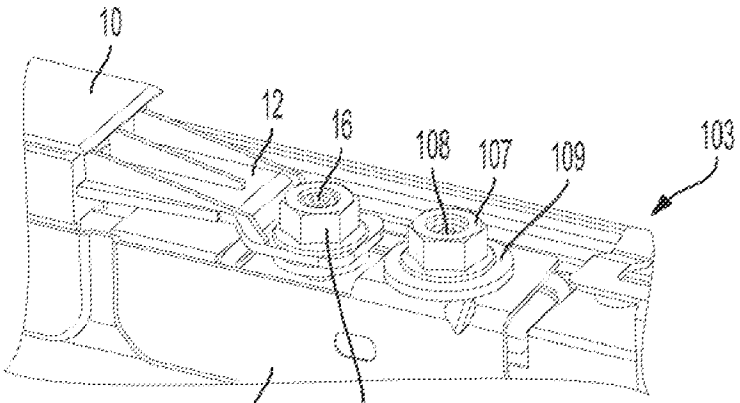
Figure 9A:
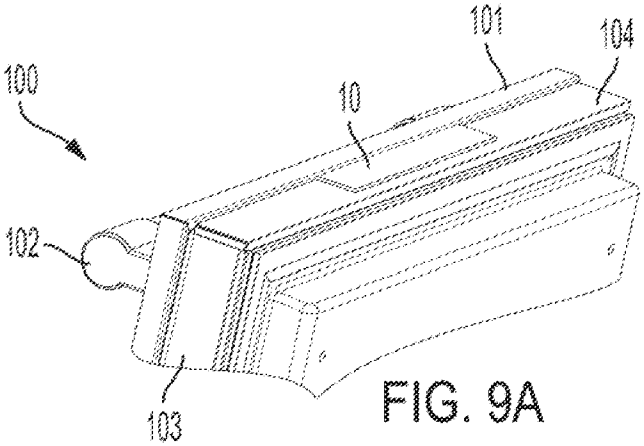
Figure 9C:
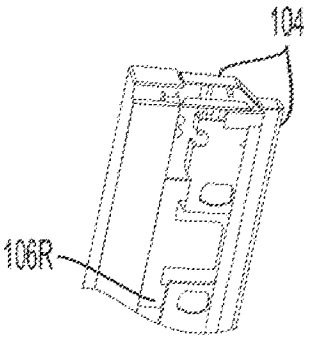
Figure 9B:
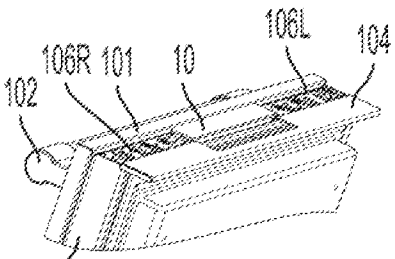
Figure 8A:
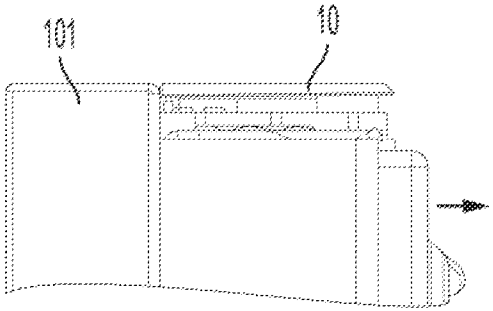
Figure 8B:
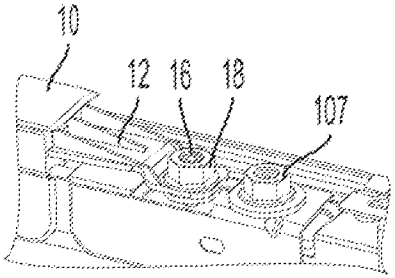
Figure 7A:
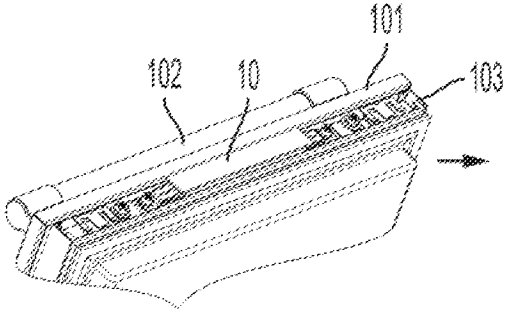
Figure 7B:
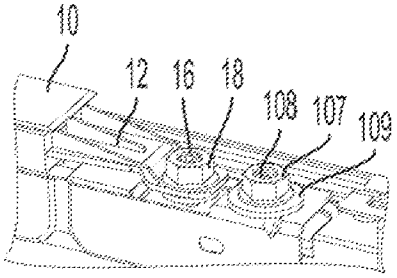
Figure 11:
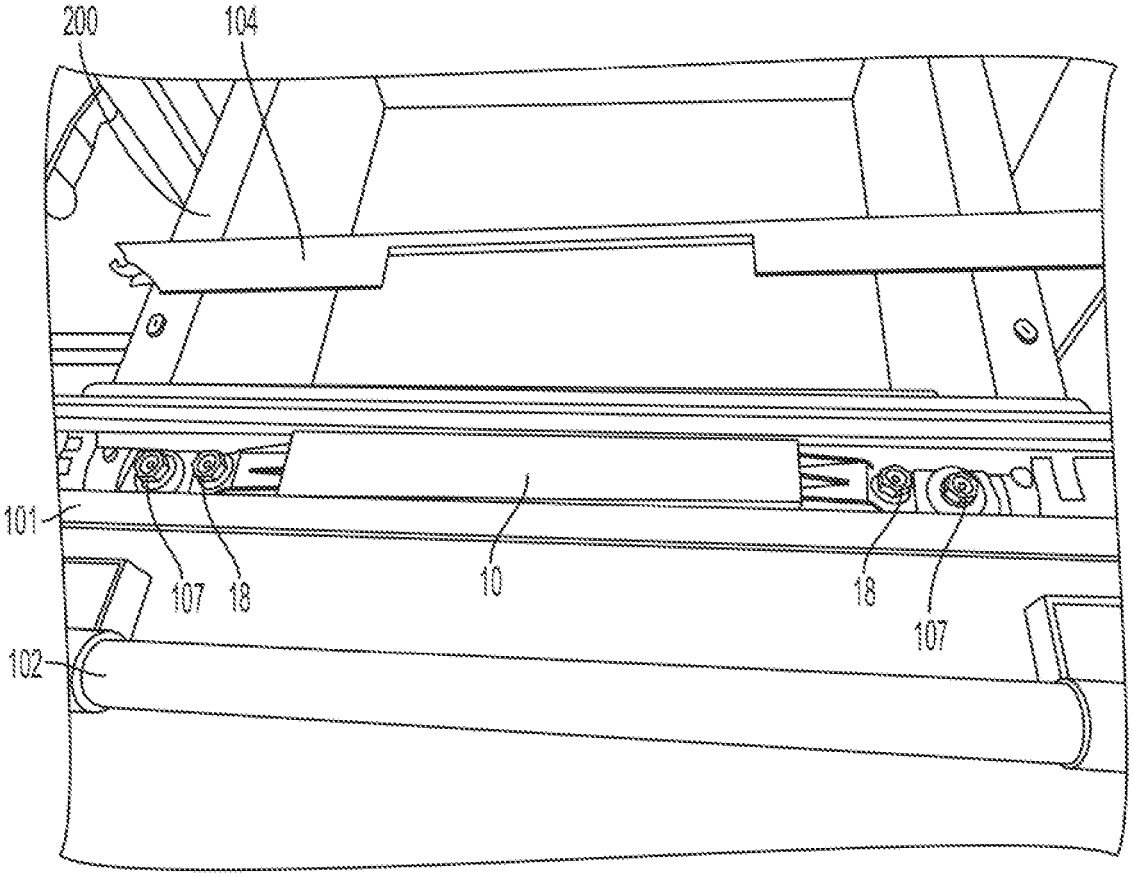
Figure 12:
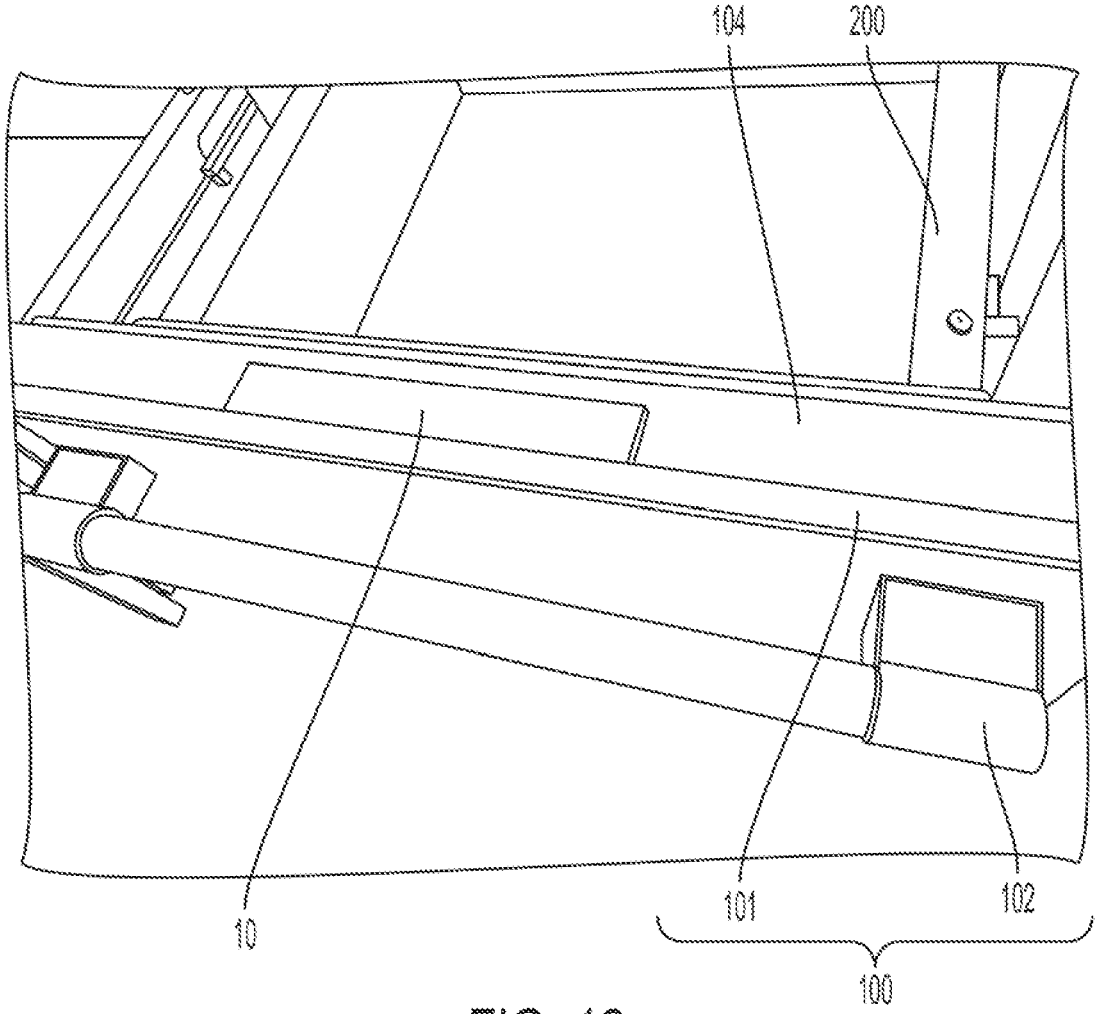
Figure 13:
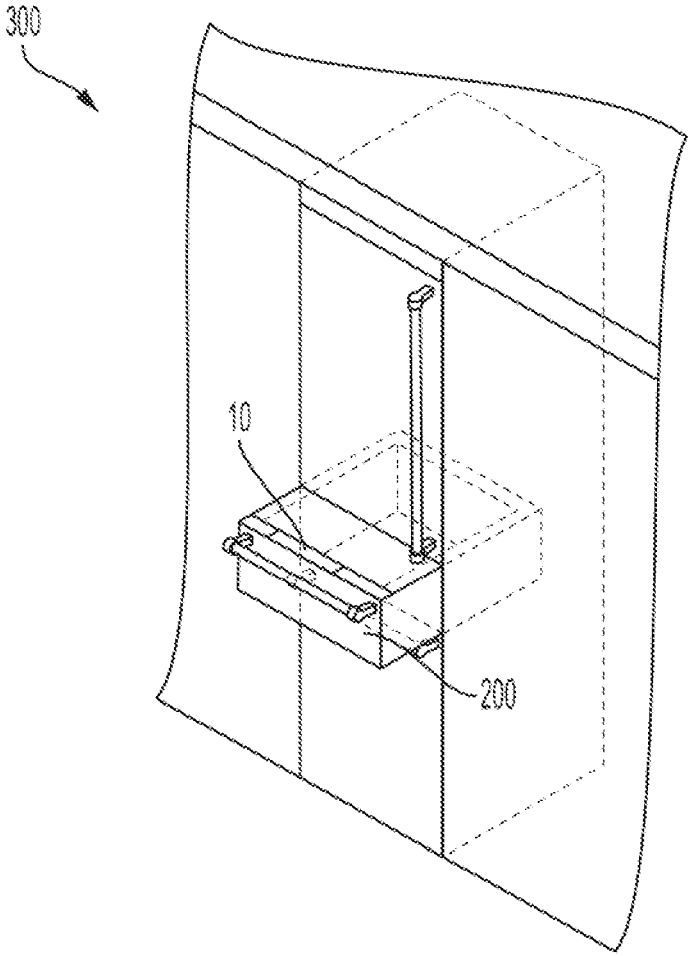
Figure 14A:
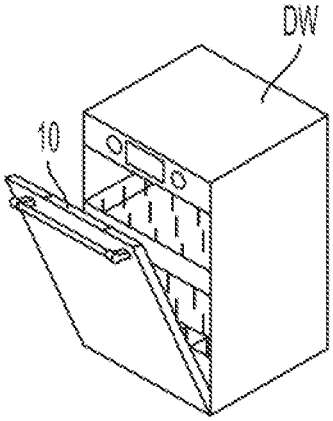
Figure 14B:
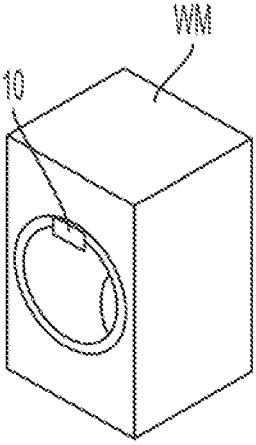
Figure 14C:
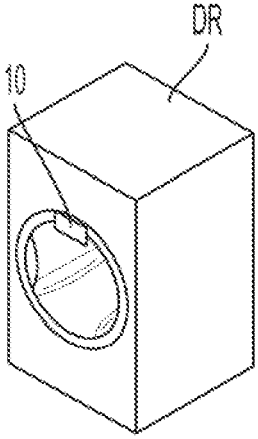
Figure 14D:
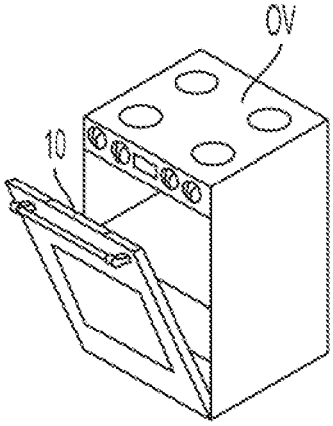

FIGS. 5A, 5B, 5C, 5D, and 5E show the installation of the UIM onto the housing according to an exemplary embodiment consistent with the present disclosure;

FIGS. 6A and 6B show the installation of the housing and top fixation bar onto the foamed door according to an exemplary embodiment consistent with the present disclosure;

FIGS. 7A and 7B show the installation and adjustment of the outer decorative door to the inner foamed door assembly according to an exemplary embodiment consistent with the present disclosure;

FIGS. 8A and 8B show the adjustment of the UIM to be flush with a top of the outer decorative door according to an exemplary embodiment consistent with the present disclosure;

FIGS. 9A, 9B, and 9C show the installation of the door top cover to the door assembly according to an exemplary embodiment consistent with the present disclosure;

FIGS. 10A, 10B, 10C, and 10D show more detailed views of the installation of the door top cover to the door assembly according to another exemplary embodiment consistent with the present disclosure;

FIG. 11 shows an enlarged top perspective view of the UIM on the door assembly with the door top cover removed according to an exemplary embodiment consistent with the present disclosure;

FIG. 12 shows an enlarged top perspective view of the UIM on the door assembly with the door top cover in mounted in place and also showing the door assembly mounted to a drawer such as adjustable temperature drawer for a refrigerator appliance according to an exemplary embodiment consistent with the present disclosure;

FIG. 13 shows the UIM on an adjustable temperature or full-flex drawer of a built-in panel front style refrigerator appliance according to an exemplary embodiment consistent with the present disclosure; and FIGS. 14A, 14B, 14C, and 14D show the adjustable UIM 10 disposed on the door of a dishwasher, washing machine, dryer, and oven, respectively, according to other exemplary embodiments consistent with the present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, middle, upper, lower, right side, left side, vertical, horizontal, downward, upward, and the like used herein are for orientation purposes with respect to the drawings when describing the exemplary embodiments and should not limit the present invention unless explicitly indicated otherwise in the claims. Also, terms such as substantially, approximately, and about are intended to allow for variances to account for manufacturing tolerances, measurement tolerances, or variations from ideal values that would be accepted by those skilled in the art.

Figure 1:
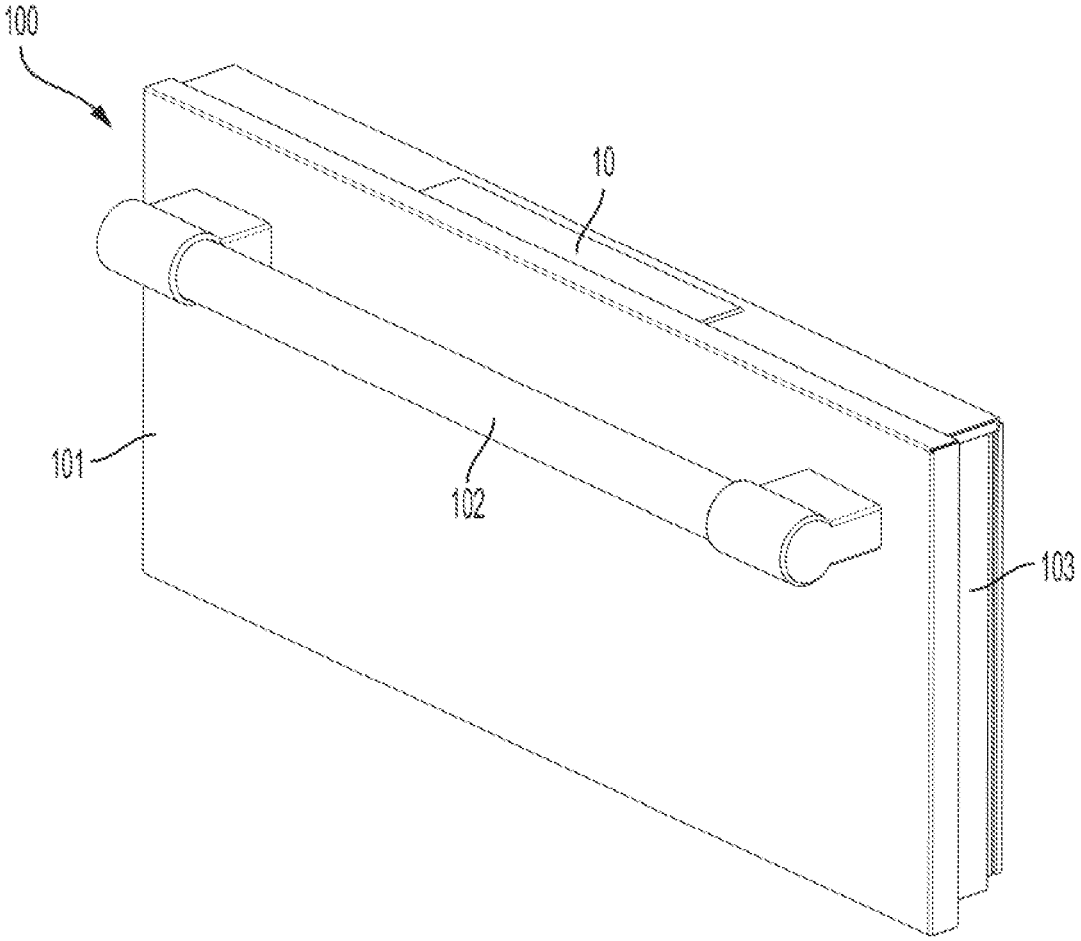

FIG. 1 shows a complete a door assembly 100 for a domestic or household appliance including an outer decorative door 101 and an adjustable user interface 10 which is flush with the outer decorative door 101 according to an exemplary embodiment consistent with the present disclosure. The outer decorative door 101 includes a handle 102. The outer decorative door 101 is removable from an inner foamed door assembly 103 of, for example, a built-in appliance's front face to allow the customer to use their custom cabinet panels in high-end kitchens to fully incorporate the appliance into the cabinetry aesthetics.

Figure 2:
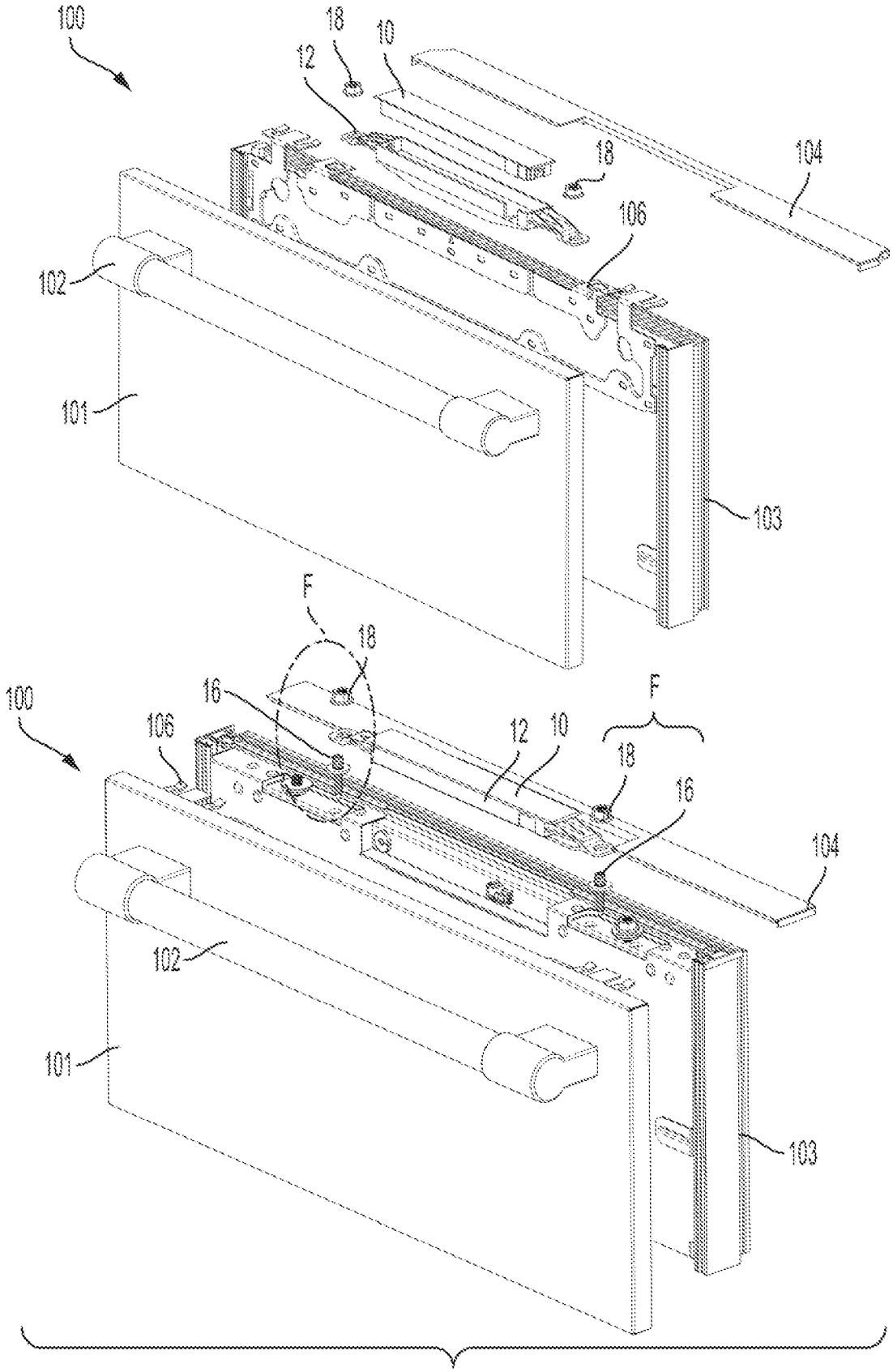

FIG. 2 shows exploded perspective views of the door assembly 100 for a domestic or household appliance and, in particular, shows the outer decorative door 101, the inner foamed door assembly 103, the adjustable UIM 10, the adjustable UIM housing or mount 12, a door top cover 104, and also shows a door fixation bar 106 (sometimes referred to as a top door fixation bar 106) both on the outer decorative door 101 (see below) and on the inner foamed door assembly 103 (see above) according to an exemplary embodiment consistent with the present disclosure. A pair of adjustable fastening members F including adjustment screws 16 for adjusting the adjustable UIM housing 12 on the right and left side thereof, as well as the two locking nuts 18 are also shown in the lower exploded view of FIG. 2. The adjustment screws 16 and locking nuts 18 will be described in more detail below.

Figure 3:
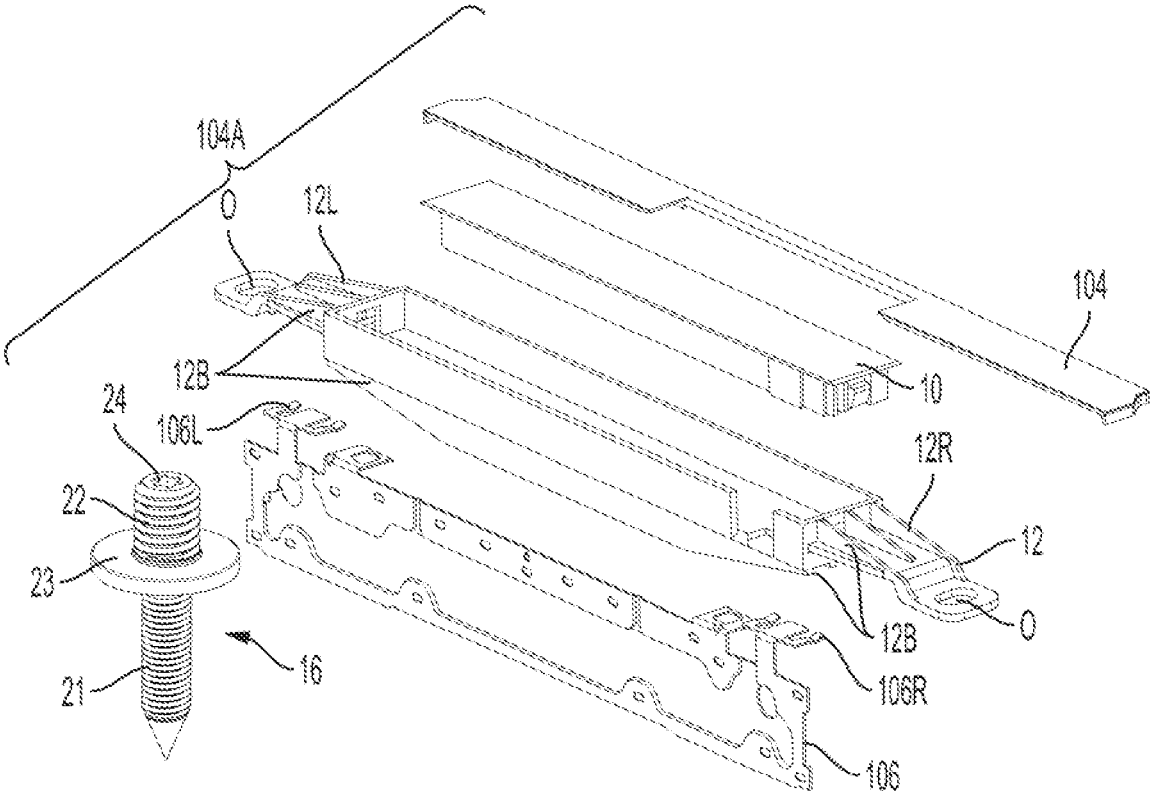
FIG. 3 is an enlarged exploded perspective view of door top cover assembly according to an exemplary embodiment consistent with the present disclosure.

FIG. 3 is an enlarged exploded perspective view of door top cover assembly 104A according to an exemplary embodiment consistent with the present disclosure. As shown in FIG. 3, the door top cover assembly 104A includes the door top cover 104, the UIM 10 which is an electronic component, the adjustable UIM housing or mount 12, the door fixation bar 106, and the adjustment screws 16 (only one of which is shown in FIG. 3). As can be seen in FIG. 3, the adjustment screws 16 are preferably specialized shoulder bolts or shoulder screws and each have a shaft with a lower threaded portion 21, an upper threaded portion 22, and a washer-shaped portion 23 fixed to the shaft of the adjustment screw 16 and separating the lower threaded portion 21 from the upper threaded portion 22. For example, but not limited to, the lower threaded portion 21 has a lower thread of m6×1.0 and the upper threaded portion 22 has an upper thread of m8×1.25. The top of the adjustment screw 16 is formed with a suitable tool-shaped indentation 24 shaped to receive the head of a like shaped fastening tool including for example, but not limited to, a flat head, phillips head, Torx® head, hex head, allen head, and the like. The fastening tool can be, but is not limited to, a manual screwdriver or wrench type tool or a matching drill bit for a power tool such as an electric power drill. FIG. 3 shows a Torx® head (e.g., T20 Torx® drive) tool-shaped indentation 24 as an example. The adjustment operation to adjust the adjustable UIM housing or mount 12 and in turn the UIM 10 will be described in detail below.

Figure 4:
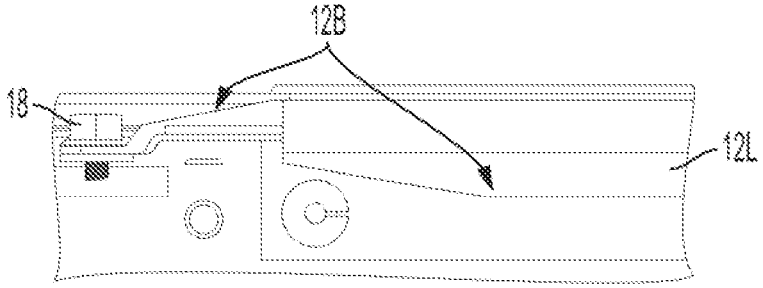
FIG. 4 is a fragmentary front view showing a left end portion of the adjustable UIM housing according to an exemplary embodiment consistent with the present disclosure.

FIG. 4 shows a left end portion 12L of the adjustable UIM housing 12 according to an exemplary embodiment consistent with the present disclosure. As shown in FIG. 4, the adjustable UIM housing 12 can be formed of plastic and can include reinforcement ribs 12B which are added to the plastic adjustable UIM housing 12 to increase rigidity. As shown in FIG. 3, the reinforcement ribs 12B are provided on the right end portion 12R and on the left end portion 12L. One of the locking nuts 18 is also visible in FIG. 4.

Figure 5A:
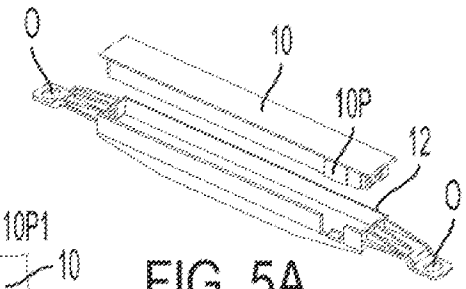
Figure 5C:
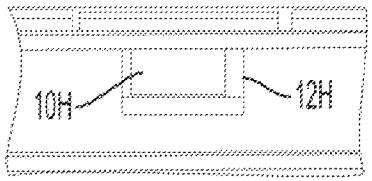
Figure 5B:
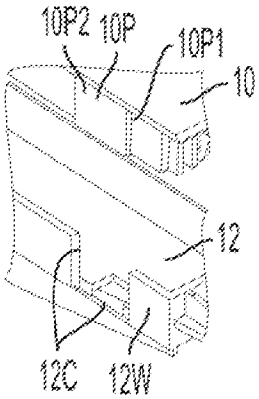
Figure 5E:
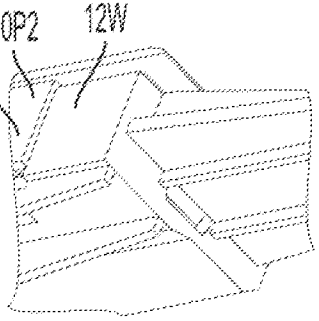
Figure 5D:
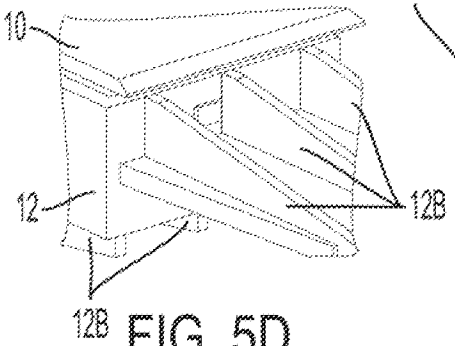

As shown in FIGS. 5A-5E, the installation of the UIM or UIM electronic component 10 onto the adjustable UIM housing 12 is depicted according to an exemplary embodiment consistent with the present disclosure. First, as shown in FIGS. 5A and 5B, the UIM electronic component 10 is aligned above the adjustable UIM housing 12. Next, a UIM electrical connector harness 10P is fed through a housing clearance hole 12C (for example, a 90 degree connector that connects into the UIM 10 and the wiring passes through the housing clearance hole or cutout 12C) and then the UIM 10 snaps as shown at 10H into the adjustable UIM housing 12 as shown at 12H (see FIGS. 5B, 5C, 5D, and 5E). As can be seen in FIGS. 5A, 5B, and 5E, the right side of the UIM electronic component 10 has a protrusion for the electrical connector harness 10P on the front that passes into the corresponding housing clearance hole or cutout 12C formed in the adjustable UIM housing 12. The protrusion for the electrical connector harness 10P has a connector part 10P1 that fits into the cutout 12C and an outer cover for the connector, and a part 10P2 that slides over a front wall 12W of the adjustable UIM housing 12.

As shown in FIGS. 6A and 6B, the installation of the adjustable UIM housing 12 and the top door fixation bar 106 onto the inner foamed door assembly 103 is depicted according to an exemplary embodiment consistent with the present disclosure. First, the adjustable UIM housing 12 is installed on top of the inner foamed door assembly 103 by threading the lower threaded portions 21 of the two adjustment screws 16 into threaded openings of the top of the inner foamed door assembly 103. By turning the two adjustment screws 16 using the appropriate fastening tool engaged in the tool-shaped indentations 24, the lower threaded portions 21 either lower or raise the height of the washer-shaped portions 23. Openings O (see FIGS. 3 and 5A) in the right end portion 12R and the left end portion 12L of the adjustable UIM housing 12 are fitted over the upper threaded portions 22 of the two adjustment screws 16 such that the bottom of the adjustable UIM housing 12 rests on the upper surfaces of the two washer-shaped portions 23. By raising or lowering the washer-shaped portions 23, the height of the right end portion 12R and the left end portion 12L of the adjustable UIM housing 12 can be adjusted. Also, since the openings O in the right end portion 12R and the left end portion 12L of the adjustable UIM housing 12 are elongated or oversized in a front to rear direction and thus larger than a diameter of the upper threaded portions 22 of the two adjustment screws 16, the adjustable UIM housing 12 can also be adjusted in a front and rear (or in/out) direction with respect to the two adjustment screws 16 and in turn the top of the inner foamed door assembly 103. Once the adjustable UIM housing 12 is in the desired position up and down and front and back, the locking nuts 18, which are threaded on the upper threaded portions 22 of the two adjustment screws 16, are tightened using an appropriate fastening tool, such as, but not limited to, a manual wrench or socket wrench or socket wrench drill bit attached to an electric power drill, on the upper threaded portions 22 of the two adjustment screws 16 to fix the adjustable UIM housing 12 in position.

As best shown in FIG. 6B, the top door fixation bar 106 is installed onto the inner foamed door assembly 103 using a similar type of adjustment screws 108 as the adjustment screws 16, so that the height in an up and down direction and the position in the front and rear direction and left and right direction can be adjusted. In this regard, note that the openings 105 (see FIG. 3) in the top of the top door fixation bar 106 are larger in diameter than the adjustment screws 108 to allow for movement in front and rear direction and left and right direction for adjustment purposes. This in turn allows the outer decorative door 101 (to which the door fixation bar 106 is fastened by means of screws, for example) to be adjusted with respect to the inner foamed door assembly 103.

As shown in FIGS. 7A and 7B, the installation and adjustment of the outer decorative door 101 to the inner foamed door assembly 103 is depicted according to an exemplary embodiment consistent with the present disclosure. As noted above, the outer decorative door 101 is first attached to the door fixation bar 106. The outer decorative door 101 is adjusted left/right and in/out by loosening a locking nut 107 and permitting the larger openings 105 (see FIG. 3) in the door fixation bar 106 to move with respect to the upper portions of the adjustment screw 108. Also, the outer decorative door 101 is adjusted in an up and down direction by tightening or loosening the adjustment screw 108. Once in the desired position, the locking nut 107 can be tightened on a washer 109 on the adjustment screw 108.

FIGS. 8A and 8B show the adjustment of the UIM 10 to be flush with a top of the outer decorative door 101 according to an exemplary embodiment consistent with the present disclosure. First, the locking nuts 18 are loosened and the adjustable UIM housing 12 along with the UIM 10 are adjusted in a front and rear (or in/out) direction with respect to the upper threaded portions 22 of the two adjustment screws 16. This allows the UIM 10 to be aligned along the back edge of the outer decorative door 101 as shown in FIG. 8A. Then, the two adjustment screws 16 are either tightened or loosened so that the top of the UIM 10 matches or is flush with the top of the outer decorative door 101 as shown in FIG. 8A. Once the UIM 10 is in a flush position with the outer decorative door 101, the locking nuts 18 can be tightened to lock the adjustable UIM housing 12 along with the UIM 10 in position (see FIG. 8B).

FIGS. 9A, 9B, and 9C show the installation of the door top cover 104 to the door assembly 100 according to an exemplary embodiment consistent with the present disclosure. As shown in FIG. 9B, the door top cover 104 is slid onto a pair of left and right fixation prongs 106L and 106R (see FIG. 3) of the top door fixation bar 106 and into the final position as shown in FIGS. 9A and 9C (note that FIG. 9C shows only the right fixation prong 106R from the bottom).

Figure 10B:
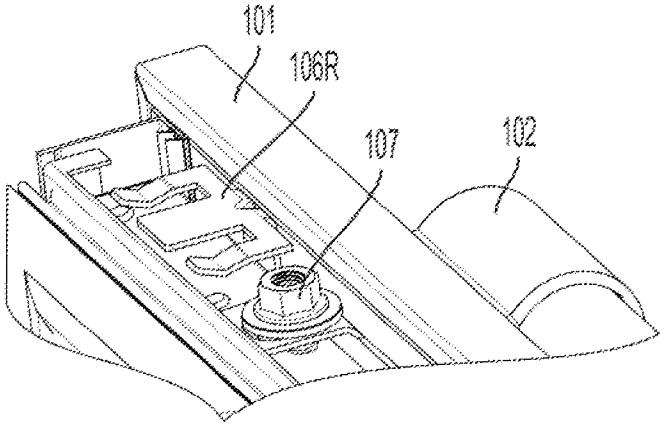
Figure 10D:
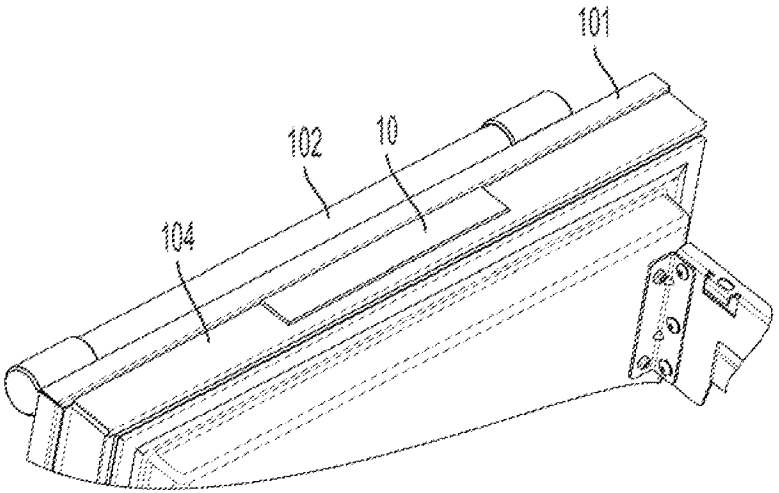
Figure 10A:
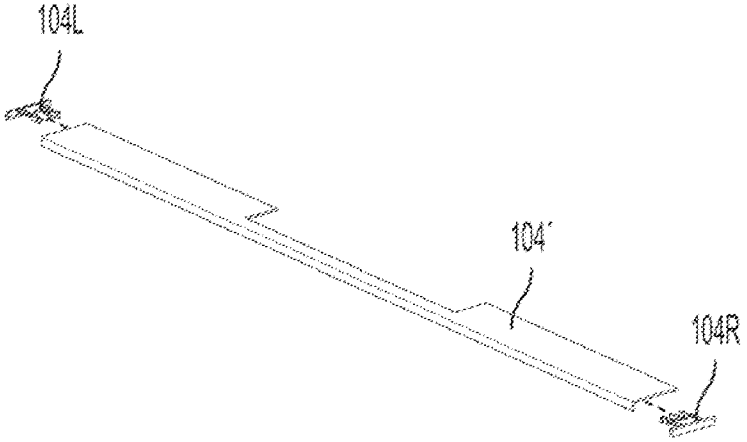
Figure 10C:
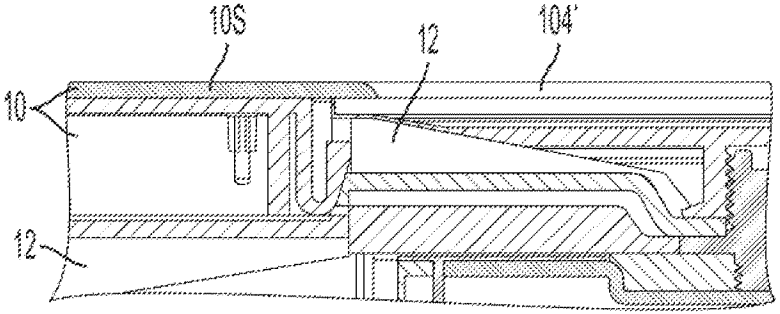

FIGS. 10A and 10B show an alternative attachment of the door top cover 104' to the door assembly 100 according to another exemplary embodiment consistent with the present disclosure. In this embodiment, the door top cover 104' has side clips 104L and 104R (see FIG. 10A) and attaches to the door fixation prongs 106L and 106R as shown in FIG. 10B. As shown in FIG. 10C, the door top cover 104' is an aluminum extrusion that slides in between a portion of the UIM 10 such as a UIM screen 10S and the top portion of the adjustable UIM housing 12.

FIG. 11 shows an enlarged top perspective view of the UIM 10 on the door assembly 100 with the door top cover 104 removed and FIG. 12 shows an enlarged top perspective view of the UIM 10 on the door assembly 100 with the door top cover 104 mounted in place. Both FIGS. 11 and 12 also show the door assembly 100 mounted to a drawer 200 such as an adjustable temperature drawer for a refrigerator appliance (not shown in FIGS. 11 and 12) according to an exemplary embodiment consistent with the present disclosure.

For food preservation, it is desirable to control the temperature inside a compartment. As an example, the adjustable temperature or full-flex drawer 200 can be a full-flex drawer that can become a freezer or refrigerator compartment due to the large temperature range. The inventors have found that it is desirable for the user to interface with an electronic interface that is close in proximity to the zone being affected by the temperature change and therefor have implemented the adjustable UIM 10 into the top of the door assembly 100 of the full-flex drawer 200 as shown in FIG. 12.

A challenge in the past for a built-in product such as a domestic appliance was the ability to implement a UIM that would align with decorative door/custom panel. If the UIM was installed on the decorative door/custom panel, the customer or installer would be responsible to install the UIM which could result in damage.

FIG. 13 shows the adjustable UIM 10 on a middle, adjustable temperature or full-flex drawer 200 of a built-in panel front style refrigerator appliance 300 according to an exemplary embodiment consistent with the present disclosure. By having an independently adjustable UIM 10, the customer/user is able to align the doors/custom panels like, for example, the outer decorative door 101, to the existing cabinetry without installing or removing the UIM 10 from the domestic refrigerator appliance 300.

Thus, consistent with of the present disclosure, the adjustable UIM can be implemented as a custom created UIM and housing that are combined as one component that has the functionality of, for example, controlling temperature and being adjusted. This is beneficial as it reduces the number of parts and reduces assembly variation.

However, the present disclosure also contemplates the use of an off-the-shelf UIM per se that can be attached to a housing that is designed to receive the UIM and act as the adjustable base. This is beneficial for lower volume production, where a specific UIM is not feasible.

Accordingly, an apparatus consistent with the present disclosure provides an adjustable UIM housing for a user interface that allows independent positional adjustment relative to the foamed door and decorative/custom panels. The installer/customer thus has the ability to install/adjust the decorative doors/custom panels to match the kitchen cabinetry without having to disconnect the user interface module. The adjustable UIM housing is also able to be adjusted vertically and in and out to match the required customer aesthetics. Vertical or height adjustability is simply done by loosening or tightening an adjustable fastening member including, for example, a specialized shoulder bolt/screw. The amount of adjustability is roughly 4 mm of upward and downward adjustability (8 mm in total). Depth adjustability (in/out) is accomplished by the elongated or oversized slots in the adjustable UIM housing. To adjust, the installer/customer has to simply loosen the locking nut above the adjustable UIM housing and slide the housing to the desired location. To fix this location, the installer/customer just tightens the locking nut again. The total adjustment provided is 4 mm to the front of the product.

The present disclosure offers several advantages over existing UIMs. One advantage is that there is a reduced risk of damage during shipment of the appliance. The factory can pre-assemble the user interface onto the foamed door. Being assembled by the factory and shipping with the appliance reduces the risk of damage to the user interface module by shipping. There is also a reduced risk of damage during door installation/servicing. In particular, the housing provides clearance to allow the decorative door to be installed and adjusted without the need to remove or disconnect the UIM. Further, the user interface module housing is able to be adjusted vertically and front to back in the door. This serves to preserve the aesthetics when dealing with production and cabinet variation. Still further, design implementation of the cover hides all hardware. Thus, with the cover installed, the customer is unable to see any hardware, and the cover also fits underneath the UIM hiding any potential gaps or mismatch caused by door adjustments.

The present invention has substantial opportunity for variation without departing from the spirit or scope of the present invention. For example, while FIG. 13 shows the UIM on an adjustable temperature or full-flex drawer 200 of a built-in panel front style refrigerator appliance 300, the present invention can be utilized in single door fresh food compartment-bottom mount freezer style refrigerator appliance, or in traditional French door-bottom mount (FDBM) configurations with two doors on top including those having one or more intermediate compartments (such as, but not limited to, pullout drawers) that can be operated as either fresh food compartments or freezer compartments and which are located between the main fresh food compartment and the main freezer compartment, or in a side-by-side refrigerator where the refrigerator compartment and the freezer compartment are disposed side-by-side in a vertical orientation, as well as in other well-known refrigerator configurations, such as but not limited to, top freezer configurations, bottom freezer configurations, configurations where the entire refrigerator unit is a fresh food compartment from top to bottom without a freezer compartment, other panel front type refrigeration and freezer configurations, and the like.

Moreover, while FIG. 13 shows the adjustable UIM on the drawer of a refrigerator appliance, the present disclosure also contemplates other configurations such as, but not limited to, integrating the UIM into other domestic appliances such as, but not limited to, freezers, ice makers, wine coolers, dishwashers, washing machines, dryers, ovens, coffee makers, and the like. For example, but not limited thereto, FIGS. 14A to 14D show the adjustable UIM 10 disposed on the door of a dishwasher DW, washing machine WM, dryer DR, and oven OV, respectively (in FIGS. 14A to 14D like parts are denoted with like reference numerals). Also, the various features described in connection with a particular embodiment can be used (mixed and matched) with the other embodiments wherever appropriate.

Those skilled in the art will recognize improvements and modifications to the exemplary embodiments of the present invention. All such improvements and modifications are considered within the scope of the concepts disclosed herein and the claims that follow.

What is claimed is:

1. An adjustable user interface module (UIM) for a domestic appliance, comprising:

an adjustable UIM housing having a mounting tab at each of a left end portion and a right end portion thereof, each mounting tab having an opening therein;

a UIM electronic component mounted to the adjustable UIM housing; and a pair of adjustable fastening members adapted to mount the adjustable UIM housing to the domestic appliance, each of the adjustable fastening members configured to engage the adjustable UIM housing through a respective one of the openings in the mounting tabs and to adjust the adjustable UIM housing in at least an up and down direction to in turn adjust the height of the UIM electronic component.

2. The adjustable user interface module of claim 1, wherein each of the adjustable fastening members comprises an adjustment screw having a shaft with a lower threaded portion, an upper threaded portion, and a washer-shaped portion fixed to the shaft of the adjustment screw and separating the lower threaded portion from the upper threaded portion.

3. The adjustable user interface module of claim 2, wherein each of the adjustable fastening members comprises a locking nut that is configured to be threaded on the upper threaded portion of a corresponding one of the adjustment screws to fix the adjustable UIM housing in position, and each of the adjustment screws is formed with a tool-shaped indentation at a top of the shaft and which is adapted to receive a head of a like shaped fastening tool.

4. The adjustable user interface module of claim 2, wherein the openings in the mounting tabs of the adjustable UIM housing are respectively fitted over the upper threaded portions of the adjustment screws such that a bottom of the adjustable UIM housing rests on upper surfaces of the washer-shaped portions of the adjustment screws.

5. The adjustable user interface module of claim 4, wherein the openings in the mounting tabs of the adjustable UIM housing are elongated in a front and rear direction and thus larger than a diameter of the upper threaded portions of the adjustment screws, such that the adjustable UIM housing is configured to be adjusted in the front and rear direction with respect to the adjustment screws.

6. The adjustable user interface module of claim 1, wherein the adjustable UIM housing, the UIM electronic component, and the pair of adjustable fastening members, are parts of a door top cover assembly that further comprises:

a door fixation bar configured to attach a door assembly to the domestic appliance; and a door top cover that is attachable to the door fixation bar and is configured such that, when the adjustable UIM housing and the door fixation bar are arranged in a proper assembly position and the door top cover is attached to the door fixation bar, the door top cover will conceal the adjustable UIM housing and the door fixation bar while revealing the UIM electronic component.

7. The adjustable user interface module of claim 1, wherein the UIM electronic component, and the pair of adjustable fastening members, are parts of a door top cover assembly that further comprises:

a door fixation bar configured to attach a door assembly to the domestic appliance; and a door top cover that is attachable to the door fixation bar and is configured such that, when the adjustable UIM housing and the door fixation bar are arranged in a proper assembly position and the door top cover is attached to the door fixation bar, the door top cover will conceal the adjustable UIM housing and the door fixation bar while revealing the UIM electronic component.

8. A drawer for a domestic appliance, comprising:

a door assembly mounted to a front portion of the drawer;

an adjustable UIM housing disposed on the door assembly and having a mounting tab at each of a left end portion and a right end portion thereof, each mounting tab having an opening therein;

a UIM electronic component mounted to the adjustable UIM housing; and a pair of adjustable fastening members which mount the adjustable UIM housing to the door assembly of the drawer, each of the adjustable fastening members configured to engage the adjustable UIM housing through a respective one of the openings in the mounting tabs and to adjust the adjustable UIM housing in at least an up and down direction to in turn adjust the height of the UIM electronic component with respect to the door assembly.

9. The drawer of claim 8, wherein the drawer comprises an adjustable temperature drawer for a refrigerator appliance.

10. The drawer of claim 8, wherein the door assembly comprises:

an outer decorative door, an inner foamed door assembly, the UIM electronic component, the adjustable UIM housing, a door top cover, and a door fixation bar; and a second pair of adjustable fastening members that mount the door fixation bar to the inner foamed door assembly, each adjustable fastening member of the second pair of adjustable fastening members configured to engage the door fixation bar through a respective opening in the door fixation bar and to adjust the outer decorative door in at least an up and down direction with respect to the inner door assembly.

11. The drawer of claim 8, wherein each of the adjustable fastening members comprises an adjustment screw having a shaft with a lower threaded portion, an upper threaded portion, and a washer-shaped portion fixed to the shaft of the adjustment screw and separating the lower threaded portion from the upper threaded portion.

12. The drawer of claim 11, wherein each of the adjustable fastening members comprises a locking nut that is configured to be threaded on the upper threaded portion of a corresponding one of the adjustment screws to fix the adjustable UIM housing in position.

13. The drawer of claim 11, wherein the openings in the mounting tabs of the adjustable UIM housing are respectively fitted over the upper threaded portions of the adjustment screws such that a bottom of the adjustable UIM housing rests on upper surfaces of the washer-shaped portions of the adjustment screws.

14. The drawer of claim 13, wherein the openings in the mounting tabs of the adjustable UIM housing are elongated in a front and rear direction and thus larger than a diameter of the upper threaded portions of the adjustment screws, such that the adjustable UIM housing is configured to be adjusted in the front and rear direction with respect to the adjustment screws and with a top of the door assembly.

15. The drawer of claim 10, wherein the adjustable fastening members are configured to adjust the adjustable UIM housing in an up and down direction to in turn adjust the height of the UIM electronic component with respect to the outer decorative door of the door assembly, such that the UIM electronic component is flush with the outer decorative door.

16. The drawer of claim 10, wherein the door top cover is configured to slide in between a portion of the UIM electronic component and a top portion of the adjustable UIM housing.

17. A domestic appliance, comprising:

a door assembly mounted to a front portion of the domestic appliance;

an adjustable UIM housing disposed on the door assembly and having a mounting tab at each of a left end portion and a right end portion thereof, each mounting tab having an opening therein;

a UIM electronic component mounted to the adjustable UIM housing; and a pair of adjustable fastening members which mount the adjustable UIM housing to the door assembly of the domestic appliance, each of the adjustable fastening members configured to engage the adjustable UIM housing through a respective one of the openings in the mounting tabs and to adjust the adjustable UIM housing in at least an up and down direction to in turn adjust the height of the UIM electronic component with respect to the door assembly.

18. The domestic appliance of claim 17, wherein the domestic appliance comprises a refrigerator appliance and the door assembly is disposed on an adjustable temperature drawer of the refrigerator appliance.

19. The domestic appliance of claim 18, wherein the door assembly comprises an outer decorative door, an inner foamed door assembly, the UIM electronic component, the adjustable UIM housing, a door top cover, and a door fixation bar, and wherein the refrigerator appliance comprises a built-in refrigerator appliance and the outer decorative door is removable from the door assembly.

20. The domestic appliance of claim 19, wherein the adjustable fastening members are configured to adjust the adjustable UIM housing in an up and down direction to in turn adjust the height of the UIM electronic component with respect to the outer decorative door of the door assembly, such that the UIM electronic component is flush with the outer decorative door.

21. The domestic appliance of claim 17, wherein the domestic appliance comprises one of a dishwasher, a washing machine, a dryer, or an oven.

* * * * *